United States Patent [19]

Gamm

[11] Patent Number: 4,547,982

[45] Date of Patent: Oct. 22, 1985

[54] WRAPAROUND POCKET FOR FOOTWEAR

[75] Inventor: Robert J. Gamm, St. Louis County, Mo.

[73] Assignee: Kangaroos U.S.A., Inc., St. Louis, Mo.

[21] Appl. No.: 459,106

[22] Filed: Jan. 19, 1983

Related U.S. Application Data

[63] Continuation-in-part of Ser. No. 436,342, Oct. 25, 1982, abandoned, and Ser. No. 190,791, Sep. 25, 1980, abandoned.

[51] Int. Cl.[4] ..... A43B 5/00

[52] U.S. Cl. ..... 36/114; 36/136; 36/50

[58] Field of Search ..... 36/114, 132, 136, 50, 36/89; 2/245, 247, DIG. 6

[56] References Cited

U.S. PATENT DOCUMENTS

| | | | |
|---|---|---|---|
| 73,010 | 1/1868 | Holland | 36/136 X |
| D. 143,391 | 1/1946 | Barlow | 36/136 X |
| D. 143,392 | 1/1946 | Barlow | 36/136 X |
| 537,364 | 4/1895 | Rogers | 36/136 |
| 654,388 | 7/1900 | Diemer | 36/136 X |
| 1,213,036 | 1/1917 | Taylor | 36/136 X |
| 1,289,341 | 12/1918 | Wirsching | 36/136 X |
| 2,019,587 | 11/1935 | Tyrrell | 36/136 X |
| 3,018,570 | 1/1962 | Bliese | 36/136 X |
| 4,366,634 | 1/1983 | Giese | 36/114 |
| 4,372,060 | 2/1983 | Adamik | 36/136 X |
| 4,476,639 | 10/1984 | Zaccaria | 36/50 X |

FOREIGN PATENT DOCUMENTS

| | | | |
|---|---|---|---|
| 1447044 | 6/1966 | France | 36/136 |

*Primary Examiner*—Werner H. Schroeder
*Assistant Examiner*—T. Graveline
*Attorney, Agent, or Firm*—Paul M. Denk

[57] ABSTRACT

In a pocket for footwear and designed to be the type to wraparound the upper front segment of the shoe, the wraparound pocket comprising a pair of liners, one being an inner liner, the other being an outer liner, approximately one end of the formed pocket securing with a proximate upper quarter portion of the shoe, while the other end of the wraparound pocket releasably secures with the upper segment of the other quarter portion of the shoe, one of the liners having a slot provided therein, and a closure in the category of a zipper providing for closing of the pocket slot during footwear usage.

12 Claims, 23 Drawing Figures

WRAPAROUND POCKET FOR FOOTWEAR

CROSS-REFERENCE TO RELATED APPLICATION

The subject matter of this application is related to the subject matter of and comprises a continuation-in-part of my earlier application having Ser. No. 436,342, filed on Oct. 25, 1982, and application having Ser. No. 190,791, filed on Sept. 25, 1980, now abandoned, and both owned by a common assignee.

BACKGROUND OF THE INVENTION

This invention relates generally to the application of a pocket to footwear, and more specifically pertains to the fashioning of a wraparound style of pocket along the upper quarter portions of a shoe to facilitate the retention of personal items such as keys, coins, or the like.

The prior art has considered the application of pockets to shoes, but particularly such pockets have generally been constructed into the vamp portion of the shoe, wherein items may be stored, such as shown in the Barlow, U.S. Pat. No. Des. 3 143,392. In this particular embodiment, the pocket is structured into the upper vamp portion of the shoe, permanently secured thereto, and has a single closure means in the nature of a zipper for opening the upper edge of the vamp wherein items may be stored. A similar type of combined shoe and purse is shown in the U.S. Pat. No. 3,018,570, to Bliese, and which is not too unlike that which has previously been described in the aforementioned Barlow patent. Various other styles of the application of pockets to a shoe or boot are shown in the Wirsching U.S. Pat. No. 1,289,341, in addition to the U.S. Pat. No. 3,631,613, to Brettell. While the pockets described therein may be useful for storing articles, the particular structure under which the pockets are fabricated, their integration into the shoe structure, and their method of usage, is quite distinct from the concept of the current invention, which is not only to provide a pocket part wherein the opening slot may be exposed upon the frontal portion of the pocket, or perhaps even in the rear liner thereof, as for concealment purposes, but in addition, the pocket itself is fashioned from a pair of liners that wraparound the upper arch of anke of the installed footwear, such as in athletic shoes, to further add some structural support for the shoe and protection for the underlying components of the foot during footwear usage.

But, consideration has been given in the prior art to providing structural support for the ankle, such as shown in the U.S. Pat. No. 3,327,410, to Park Sr. et al., wherein an integrated strap may wrap upwardly around the ankle to add bracing in the form of an ankle support during usage of the shown athletic shoe. The hockey boot to Westfall, in U.S. Pat. No. 1,545,623, discloses the use of strap means for enhancing ankle support for the wearer of the shoe during participation in that athletic event. Similar type construction is shown in the skating and hockey boot as invented by Johnson, in U.S. Pat. No. 1,139,530. But, the current invention, as distinct from what is shown and described in the variety of prior art patents, integrates not only anklet and upper arch support in the application of the shoe of the foot of the wearer, but in addition, does add that additional feature of providing a pocket part therein for securement and retainment of personal items, even during participation in an active sporting event such as basketball, football, jogging, or the like.

It is, therefore, the principle object of this invention to provide a wraparound pocket part that may be used for securement of personal items, and at the same time snugly embrace the frontal portion of the ankle underlying the athletic shoe in which this invention is embodied.

Another object of this invention is to provide means for concealment of personal items within a pocket wherein the pocket slot may be substantially concealed within a block liner for the wrap around style of pocket design as integrated into the shoe structure.

Still another object of this invention is to provide means for substantially bracing the upper metatarsus, arch, and ankle portion of the foot upon which the footwear of this invention is applied.

Yet another object of this invention is to embody the principles of this design into casual footwear.

These and other objects may become more apparent to those skilled in the art upon reviewing the summary of this invention, and upon undertaking a study of the description of the preferred embodiment, in view of the drawings.

SUMMARY OF THE INVENTION

This invention envisions the formation of the usual style of athletic shoe, such as the low cut type, the high top basketball shoe, and for that mattr, even the various styles of boots, hunting boots, or even casual shoes, since the concept of this invention can be built into and used in conjunction with a variety of styles of footwear. More specifically, though, the concept of this invention is two-fold, to provide a formed pocket in which various types of personal items such as keys, coins, or the like, can be inserted and stored for safekeeping, as during participation in an athletic event, and in addition, and particularly where this invention is embodied within the construction of an athletic shoe, to furnish an element of protection at those areas of the foot that are very vulnerable to receiving an impacting blow, that may frequently lead to injury, damage, or even broken bones, and particularly in the area of the instep, where the metatarsus bones are located, or higher up therefrom, as where the front of the ankle bones locate, and the variety of bones arranged intermediate thereof, such as the oscalcis, and related orthopedic structures.

More specifically, this invention contemplates the formation of the usual style of shoe, having the sole portion, the quarter potions, heel, and vamp parts, or various combinations thereof, all integrally structured for connection to the shoe sole, with the concept of this invention comprising the formation of a wraparound style of pocket that locates essentially along the upper quarter portions of the shoe, and designed for overlying the upper frontal portion of the footwear as the pocket is arranged in overlying relationship extending approximately from side-to-side of the formed shoe. The pocket is basically formed at least a pair of liners, comprising an outer liner and an inner liner, which are essentially connected together around their periphery, in order to form a pocket part therein, and having an access opening therein, and whether it be through either of the outer or the inner disposed liners. Generally the pocket opening or slot will be closed by means of a closure means, such as a zipper, or the like, in order that once valuables are stored within the formed pocket, as during application and usage of the footwear, such closure means may be fastened into containment for safe retention of the stored items therein. The specific location for the pocket slot, and its closure means, is not essentially critical, since the slot may be formed through the front liner, or the back liner, or even arranged vertically or horizontally upon the pocket, and for that matter, could even be located at other angular relationships, or even along one of the marginal edges, such as the upper marginal edge formed between the front and inner liners for the formed pocket.

The pocket, as formed through its liners, are adhered to the upper frontal portion of the shoe, as along its side edges, and in that manner usually overlie the upper vamp part of the shoe, as where a casual shoe may be involved, or may overlie the upper lacings for the footwear, such as where an athletic shoe may be of concern. In any event, one or both edges of the formed pocket, as along the inner side edges of the pocket, may contain a fastening means, such as Velcro, for furnishing the snug attachment of the pocket to the shoe during its application. But, more preferably, at least one side edge of the pocket will be permanently affixed to the upper quarter portion of the shoe, as by stitching, or other means of more permanent retention, such as through fasteners or snap clasps, while the opposite edge of the formed pocket may likewise contain a clasp, or a hook and pile connecting means, such as Velcro, for adhering that side of the pocket to the opposite upper quarter portion of the shoe, during its installation.

It is also likely that even though the pocket may be storing more miniscule sized items, such as keys, coins, or the like, as during application of the shoe and its pocket, such items, since they are of hardened texture, may have a tendency to bind against the frontal surface of the shoe, and the upper metatarsus or ankle bones, as aforesaid, underlying thereat, and in that case, it may also be desirable to include some padding, at least within the back liner for the formed pocket, in order to prevent any inconvenience or discomfort to the wearer of the shoe during its usage. To achieve such, the padding may be contained internally of the disposed inner liner, and rest against the surface of the foot, or the padding may be contained internally of the pocket, even upon both inner surfaces of the front and rear liners, or each liner may actually be formed as a double liner, and having padding or cushioning means provided intermediate thereof to provide a more permanently installed type of padding that will be more likely to resist deterioration.

The concept of this invention may even be applied to a more casual style shoe, and once again, have the disposed pocket arranged approximately at the upper quarter portions for the formed shoe, and extending from side to side arranging its pocket essentially at the frontal portion of the constructed shoe.

BRIEF DESCRIPTION OF THE DRAWINGS

In referring to the drawings, FIG. 1 provides a left side view of a basketball shoe incorporating the wraparound pocket of this invention.

DESCRIPTION OF THE PREFERRED EMBODIMENT

Figure 1:
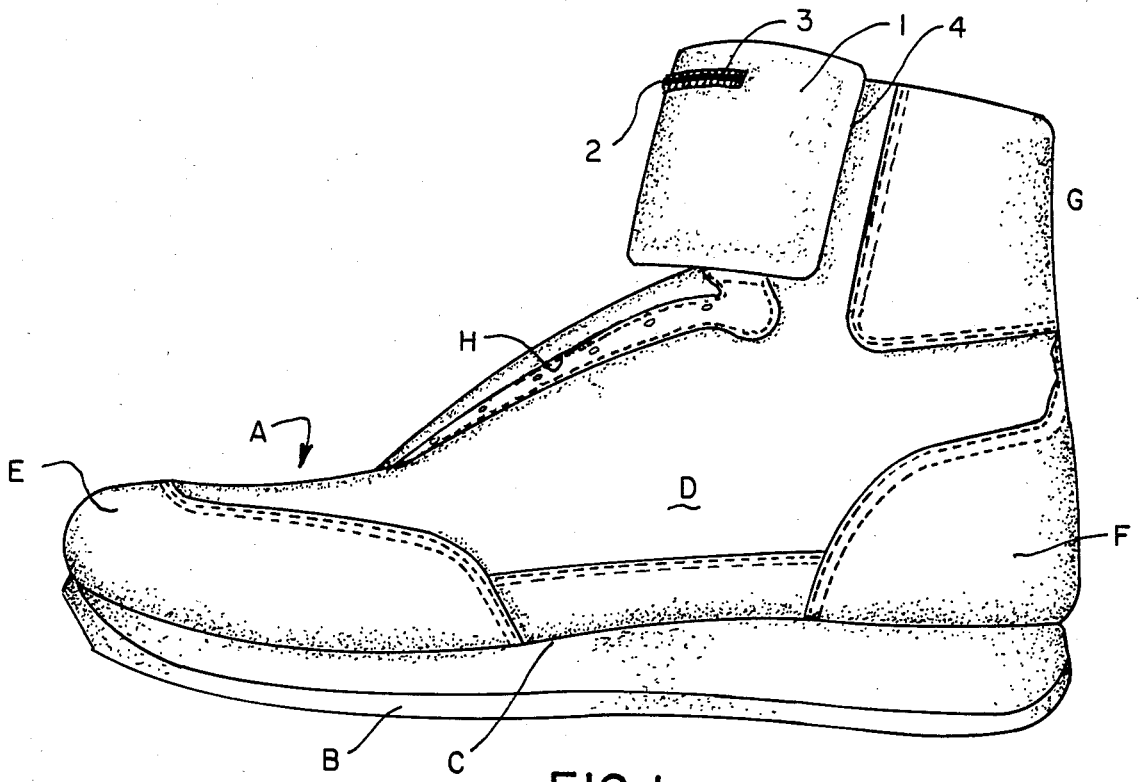
Figure 2:
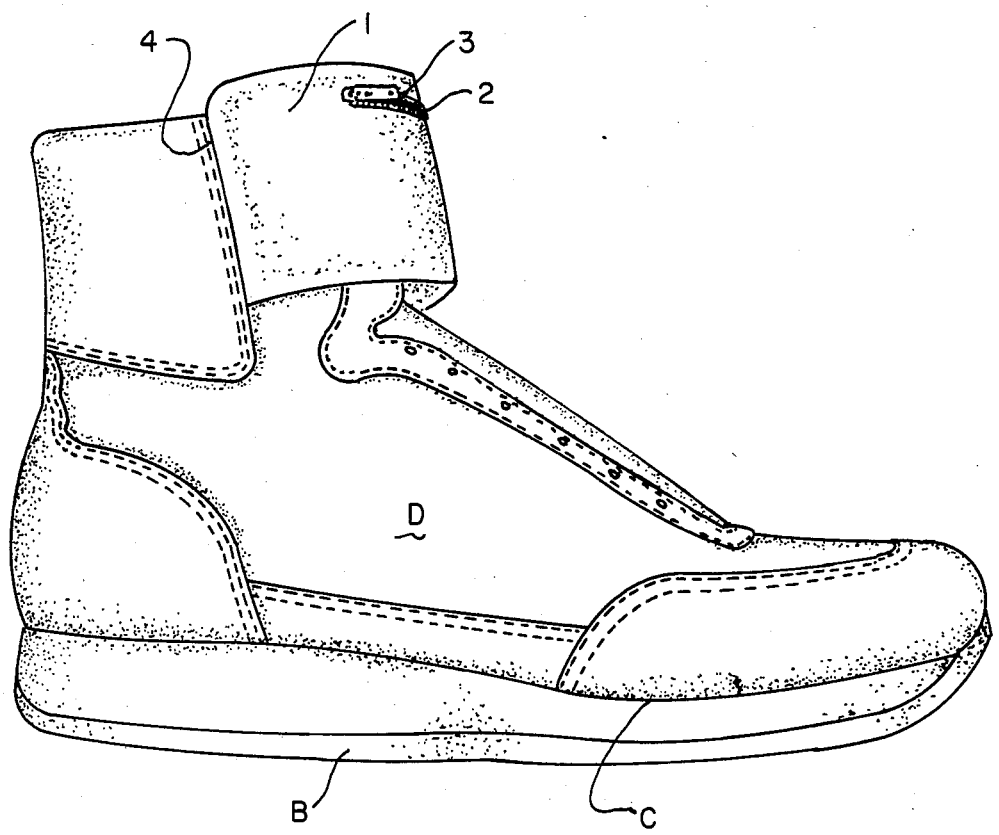
FIG. 2 provides a right side view thereof.
Figure 3:
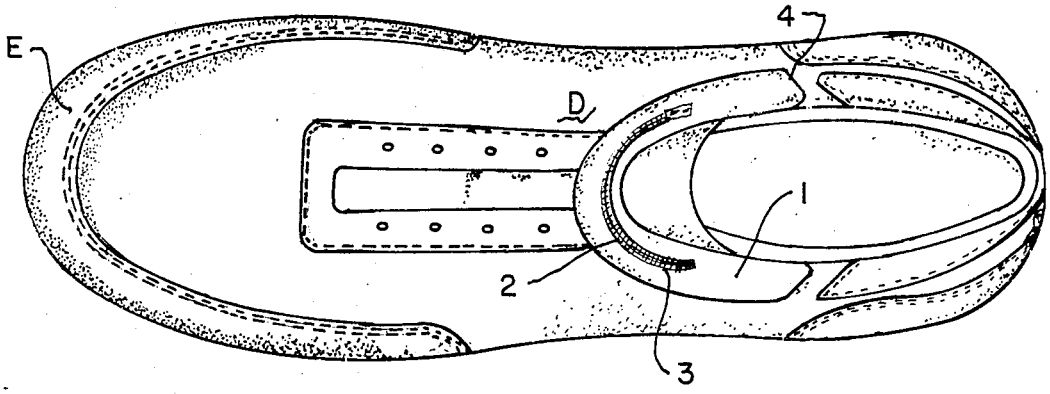
FIG. 3 provides a top view thereof.
Figure 4:
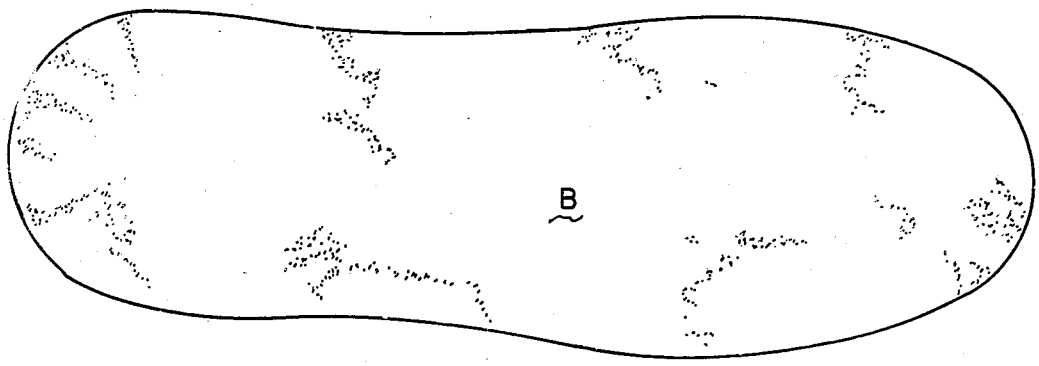
FIG. 4 provides a bottom view thereof.
Figure 5:
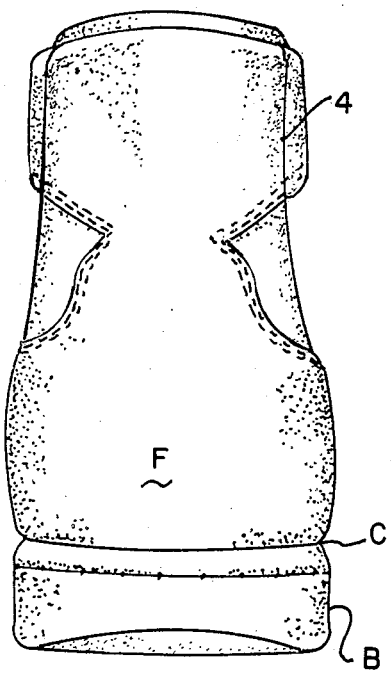
FIG. 5 provides a back view thereof.
Figure 6:
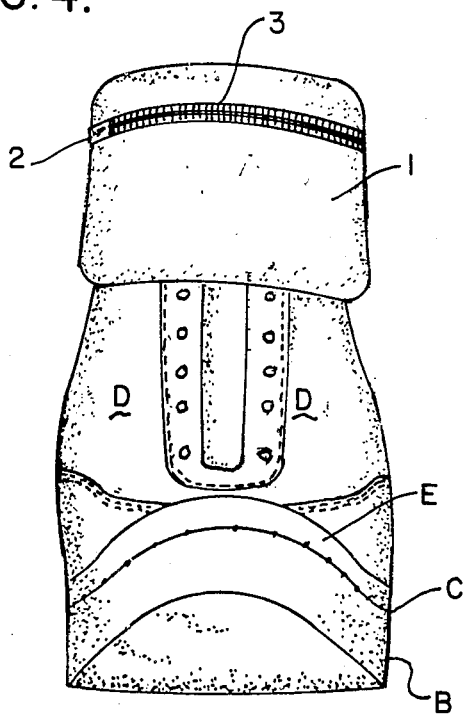
FIG. 6 provides a front view thereof.

In referring to the drawings, and in particular FIGS. 1 through 6, one embodiment of this invention is shown, and comprises, in this particular instance, an athletic shoe, such as a basketball shoe, wherein its shoe upper A is secured to its sole portion B along its shank C by means of any form of lasting, stitching, adhesive, or the like, as customarily used in the trade. This shoe usually contains the various other components embodied into its construction, such as a quarter portion D having a vamp E located forwardly thereof, and a heel portion formed at the counter F. There may or may not be located a rear ankle protector, as at G, although parts of this design frequently are embodied in the usual style of athletic shoe, basketball shoe, boot, or the like, as constructed. Formed along the upper edge of the quarter portion D, as at its forward location, is the eyestay H, one being formed at either side in order to accommodate the usual lacing (not shown) useful for tying the shoe into closure when applied to the foot. This eyestay H, and its accompanying lacing, usually extends upwardly into the upper region of the quarter portion D, as is well known.

The basics of this invention comprises the wraparound pocket 1, shown comprising a liner of material having some height, and usually to that height that will allow for, at least in the design of the basketball shoe, some protection at the frontal portion of the ankle, just above the metatarsus, as the shoe is applied during usage. A closure means, such as the zipper means 2, is provided, in this particular instance, proximate the upper front portion of the formed pocket, and is secured upon a slot, formed therein, as at 3, to furnish closure to the pocket opening after valuables have been inserted herein, or following their removal. The wraparound pocket 1 is also formed having a length that provides for its arcuate disposition around the front of the upper part of the shoe, as shown, so that its side edge, may include fastening means such as of the hook and pile construction, or other means of fastening, for adherence either permanently, or releasably, at least at one side, at the upper frontal portion of the quarter portions D furnished laterally of the structured shoe.

Figure 7:
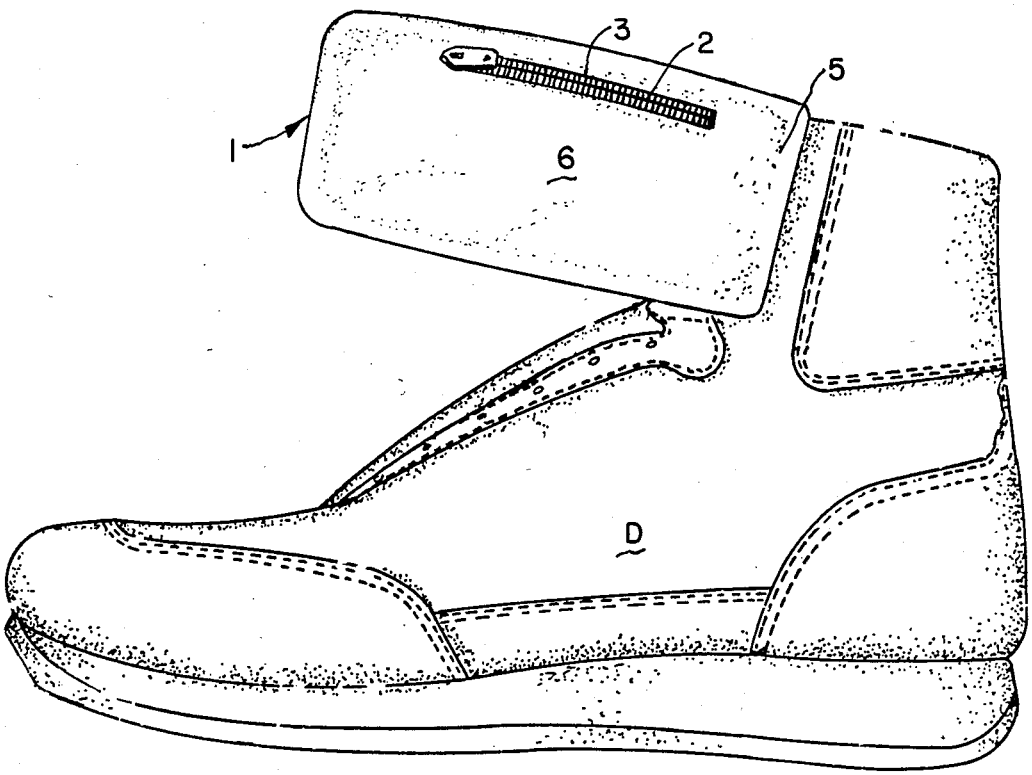
FIG. 7 provides a left side view showing the wraparound pocket extended as during application.
Figure 8:
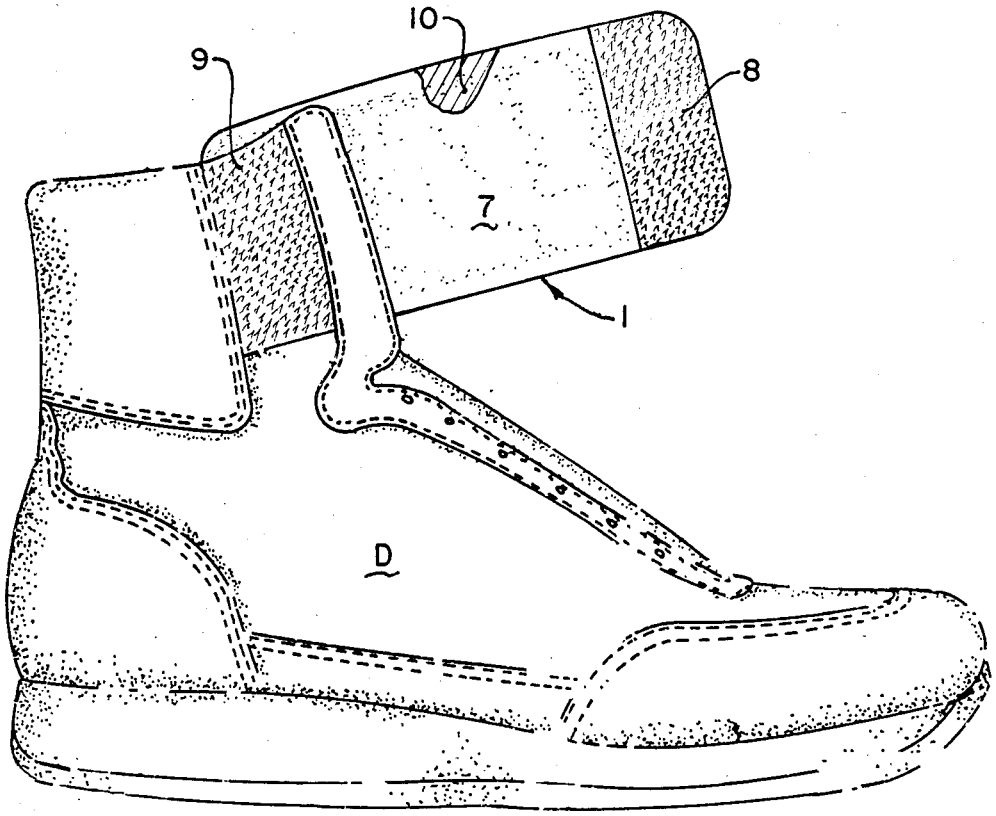
FIG. 8 provides a right side view of the shoe shown in FIG. 7.

Referring to FIGS. 7 and 8, wherein the wraparound pocket is shown partially opened, as during application, or removal, it can be seen that, in this particular instance, the pocket 1 is permanently fastened as along its right side edge, as at 5, to the upper quarter portion D of the shown shoe, and such fastening may be accomplished by means of stitching, adhesive, snap type clasp, or other form of fastening that will provided a more permanent form of attachment to the shoe. It can also be seen that the pocket is formed from a pair of liners, one comprising an outer liner 6, while the other part includes an inner liner 7, and which liners are generally connected around their periphery, to form a pocket having the enclosure type space located interiorly thereof. At the opposite end of the formed pocket, as at 8, and along the interior liner 7, there may be provided means for releasably attaching the wraparound pocket to the shoe structure, and in this particular instance, it is shown as incorporating a laminate of Velcro, being of the hook and pile configuration, with one of this combination being secured to the proximate edge of the inner liner 7, while the other part of the Velcro is permanently adhered to the upper frontal surface of the shoe quarter portion D, as shown at 9. Obviously, a snap clasp, or other type of releasable fastener, may be used for securing this opposite end of the wraparound pocket 1 to the shoe structure, as during usage.

The pocket may be formed simply of a pair of liners, such as the liners 6 and 7 as previously explained, but in order to enhance the comfort of the pocket upon the shoe during its usage by the athlete, or other person, the pocket may be formed having some cushioning means, such as matting, polyurethane, or any other type of means that provides comfort, and such cushioning, as shown at 10, may be arranged upon the inner surface of the inner liner 7, or even outside of said liner, so as to cushion the pocket and the ankle thereunder, as the wraparound pocket is applied during its usage. Likewise, similar type of cushioning means may be provided within the outer liner 6, in order to furnish a means for softening the effects of any hardened item that may be located therein, such as keys, coins, or the like, and to prevent any discomfort to the athlete, or any wearer of the shoe.

Figure 12:
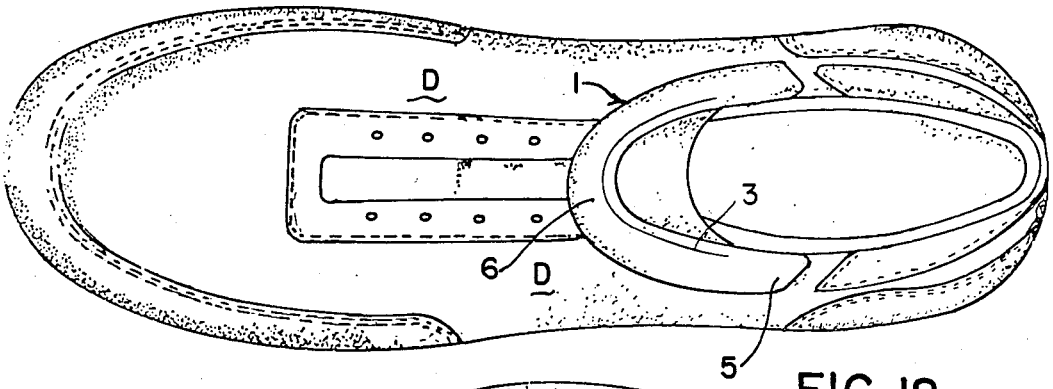
FIG. 12 shows a top view of a modified form of the invention, with the pocket slot arranged along the upper margin.

As previously explained, a zipper or other closure means 2 may be used for closing of the formed pocket slot, as at 3, and while the particular slot shown, and closure means 2, is arranged horizontally along the upper surface of the outer liner 6 of the pocket, it is just likely that the particular pocket slot may be arranged at other locations upon the formed pocket, such as vertically disposed therewith, along an angle, or diagonally, or even along one of the margins, such as the upper margin, as where the upper edges of the outer liner 6 and the inner liner 7 meet see FIG. 12.

Figure 9:
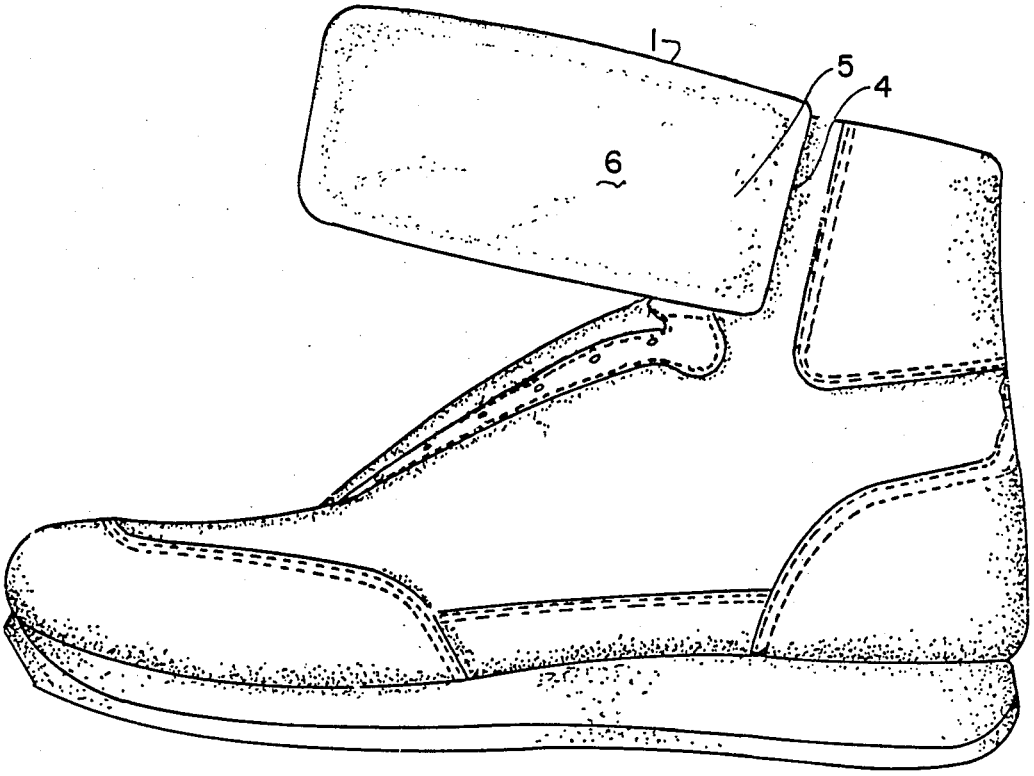
FIG. 9 discloses a left side view of a shoe with wraparound pocket, partially opended, but slightly modified in so far as the pocket slot is located through the inner linner.
Figure 10:
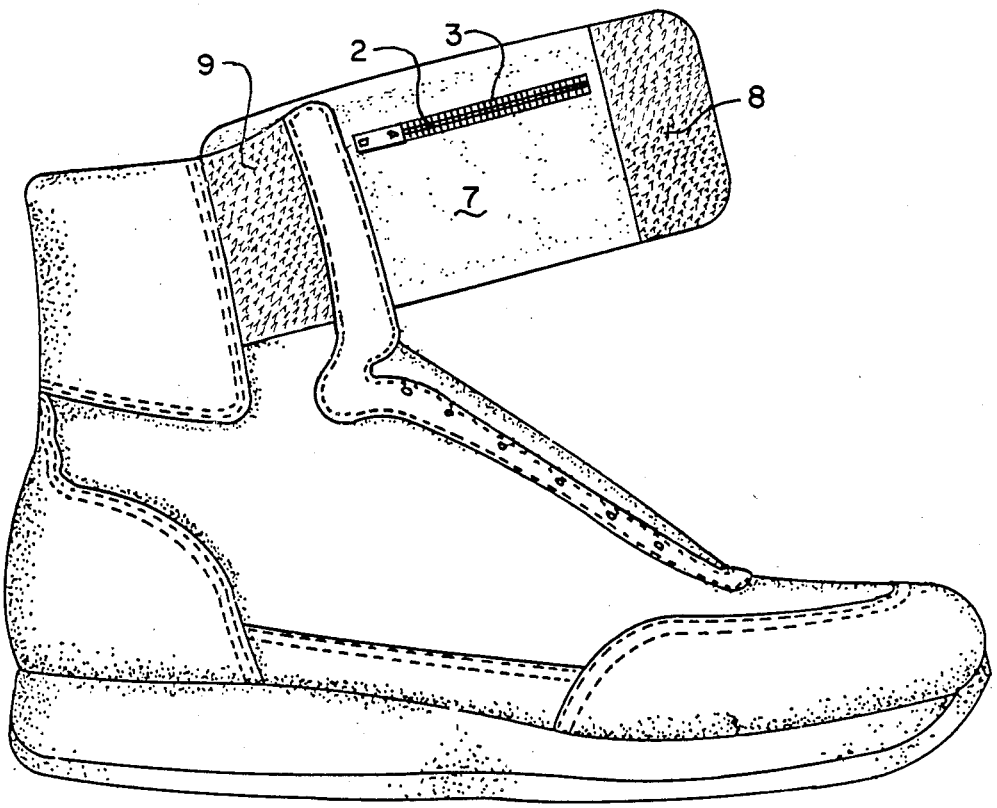
FIG. 10 provides a right side view of the shoe shown in FIG. 9.
Figure 11:
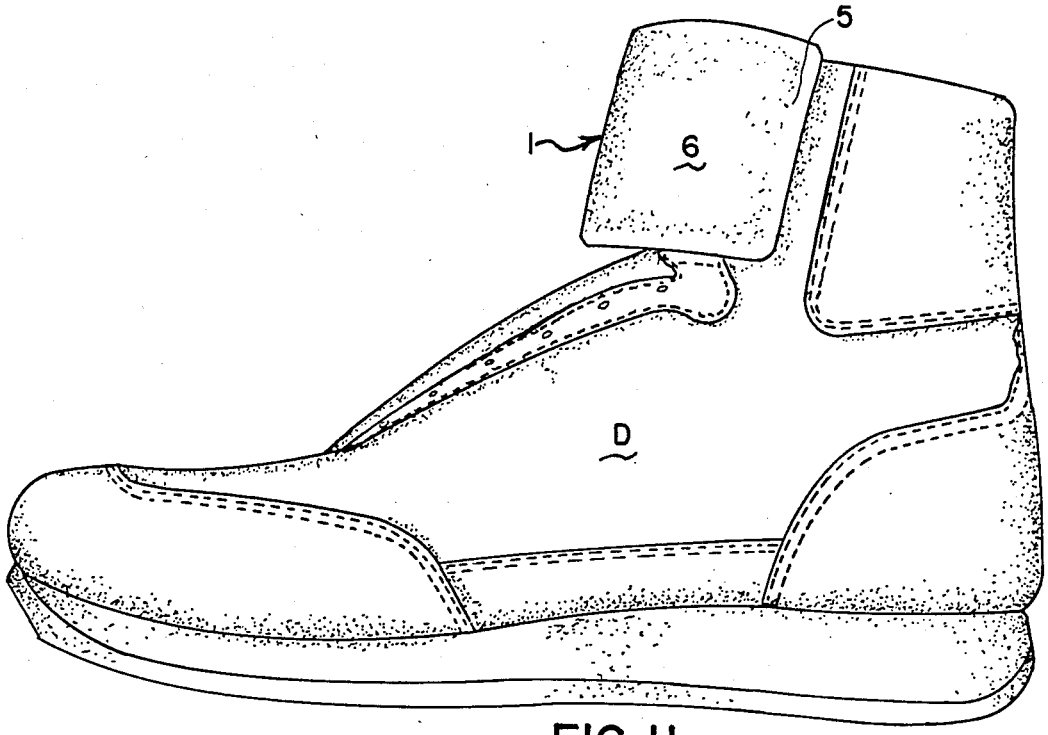
FIG. 11 shows a left side view of the shoe shown in FIG. 9, with the wraparound pocket secured as during application.
Figure 13:
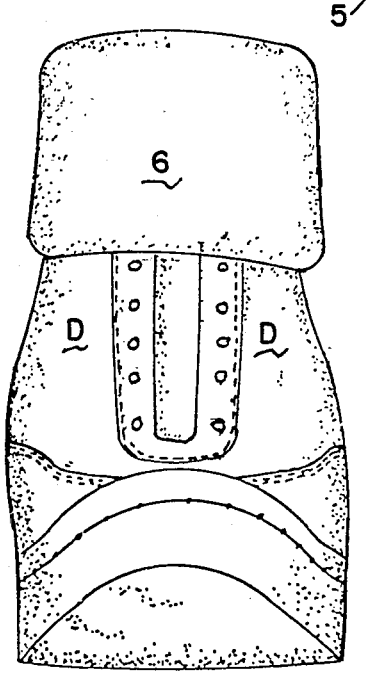
FIG. 13 provides a front view thereof.

In addition, and as can be seen in FIGS. 9 and 10, the closure means 2 may likewise be formed in a manner that furnishes concealment to the location of the pocket slot 3, and as shown, in this particular instance, the pocket slot is formed through the inner liner 7, to any angular relationship, such that when the wraparound pocket is applied for usage, as shown in FIGS. 11 through 13, the wraparound feature of the pocket may be shown as an appendage to the athletic shoe, but does not conceal that the formed pocket of liners as at 1 may have any attributes to function as a pocket, or for retaining and concealing any personal items that may be located therein. This is clearly shown through the structure of the modified athletic shoe depicted in said FIGS. 9 through 13.

In the particular instance for the style of athletic shoe, having the wraparound pocket thereon, as shown in these FIGS. 1 through 13, it should be readily apparent that the formed pocket is arranged slightly higher up upon the structure of the formed footwear, and in that position adds both comfort and protectiveness to the front of the ankle bone, at a location upwardly from the metatarsus bones, so that should any kick be directed towards the foot at this location, protection will be provided through the locating of the pocket at this position, and most specifically such protectiveness is enhanced particularly when a cushioning means, such as the matting 10, or the like, is located and constructed into the formation of the wraparound pocket.

Figure 14:
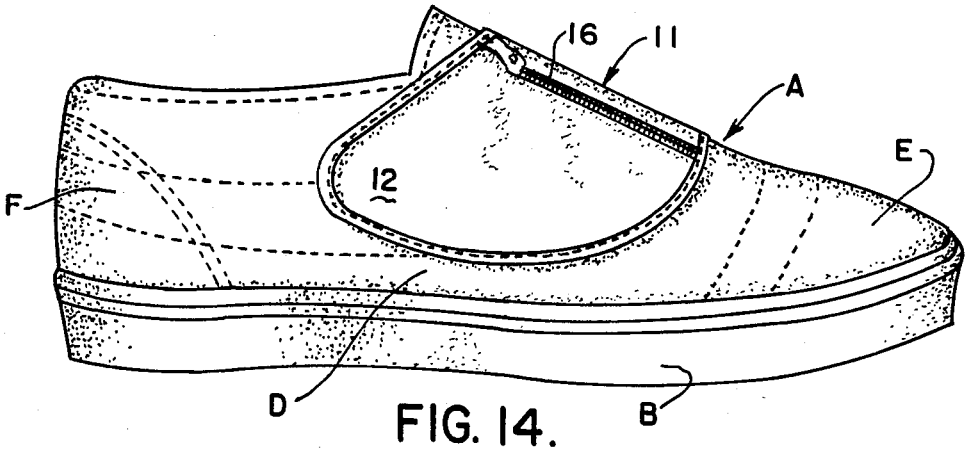
FIG. 14 discloses a modification to the wraparound pocket for footwear, in this instance, comprising a casual shoe.
Figure 15:
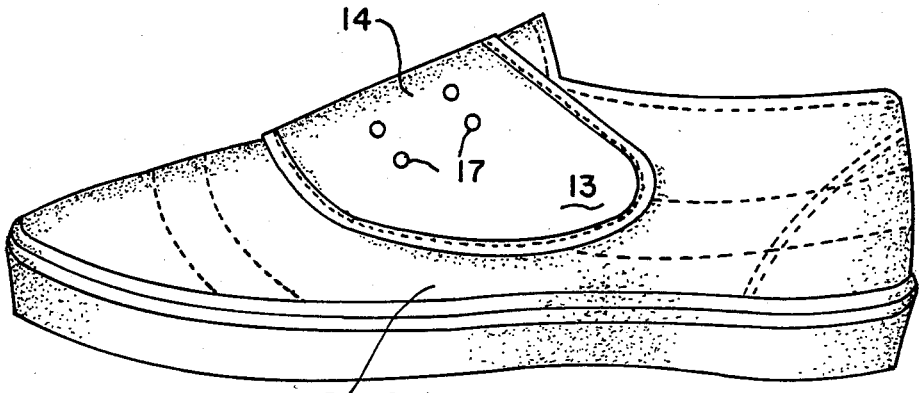
FIG. 15 provides a left side view.
Figure 16:
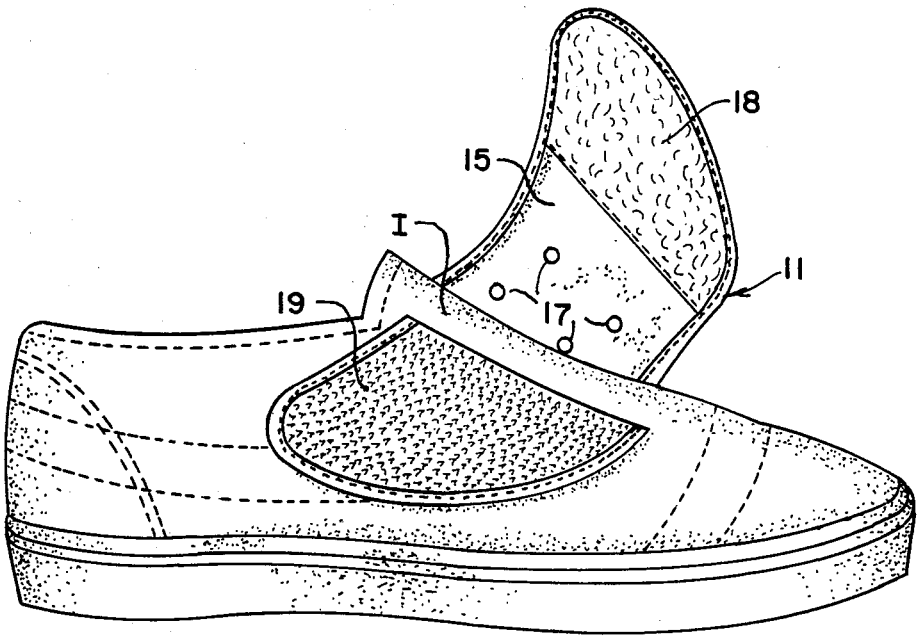
FIG. 16 provides a right side view thereof, with the pocket partially unwrapped.
Figure 17:
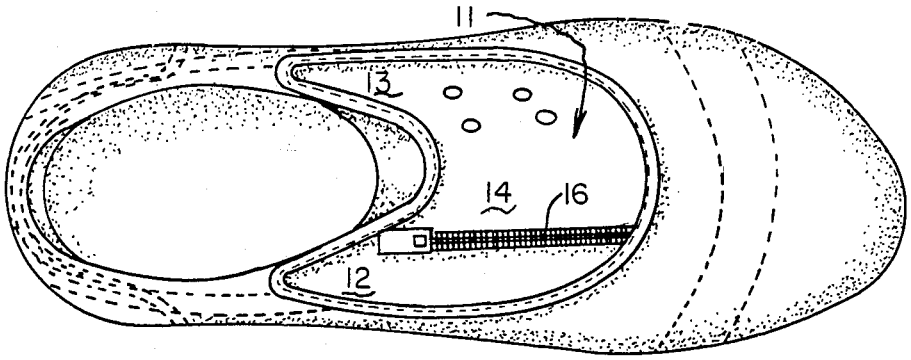
FIG. 17 provides a top view thereof.
Figure 18:
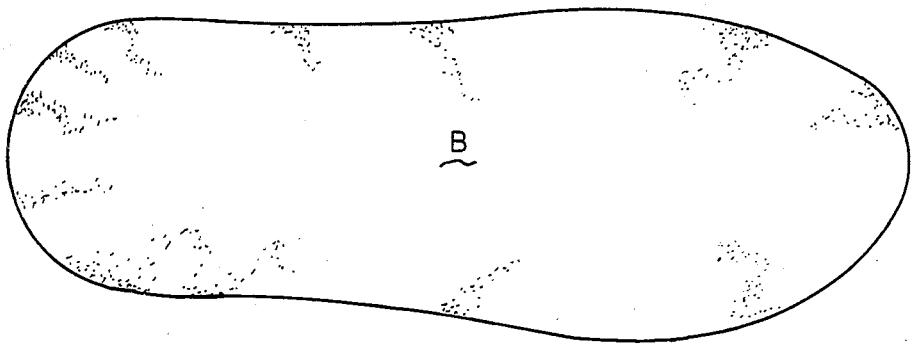
FIG. 18 provides a bottom view thereof.
Figure 19:
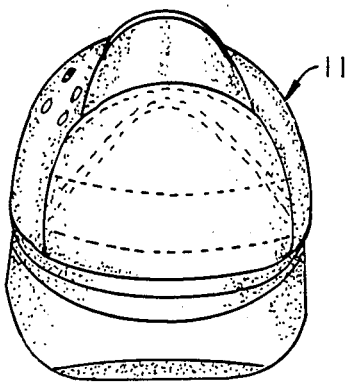
FIG. 19 provides a back view thereof.
Figure 20:
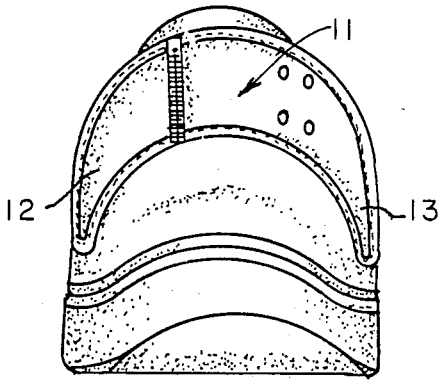
FIG. 20 provides a front view thereof.

There are other instances, though, where this style of wraparound pocket may be fabricated into a modified style of footwear, and as shown in FIGS. 14 and 15, in this particular instance, the footwear may comprise a lowcut athletic shoe, or even a casual shoe, as shown at A. In this particular instance, the vamp portion E, quarter portions D, and heel and counter portions F are once again lasted or otherwise secured to the sole B of the shown shoe. And, once again, a wraparound style of pocket 11 is shown being arranged in overlying fashion upon the upper quarter portions D of the disclosed shoe, and also being arranged at the upper vamp portion E of the same shoe. In this particular instance, the formed wraparound pocket 11 not only may conveniently contain the various personal items of the type as previously explained, but in addition, it may add to the protection of the metatarsus bones directly thereunder as formed of the foot of the wearer of this particular style of shoe. The wraparound pocket extends from its one end 12 and around the upper front portion of the shoe, and over to its opposite end, as at 13, arranged upon the opposite quarter portion of the same shoe. In this particular instance, the pocket portion 11 may be secured at one or both of its ends to the quarter portions of the shoe structure, and preferably, although not necessary, will be more permanently adhered at one end, such as at the pocket end 13, as previously identified, while its opposite end 12 may be free for release from the shoe so that the wraparound pocket may be lifted upwardly, particularly in those instances where it may add to the convenience of installation of the shoe upon the foot of the wearer. As can be seen also in FIG. 16, the wraparound pocket 11 overlies the tongue or gusset portion I of the formed shoe, and frequently, particularly where the lowcut style of athletic shoe may be involved, similar type of lacings to that as previously identified may be embodied at this location, and having the wraparound pocket being partially removable, as disclosed, provides for ready access to the lacing when they are to be installed or removed as necessary. And, frequently, where the casual shoe is involved, there also may be provided some form of elasticity at the location of the portion I of the formed shoe, so as to furnish some give to facilitate the insertion of the foot into the shoe during installation or removal. Thus, having the wraparound pocket of the style as shown in FIG. 16, where it may be partially opened, or removed, provides for ready access to these various components of the shoe during its application.

The formed wraparound pocket 11 may be constructed in a manner similar to the pocket 1 as previously explained, and in this particular instance, may likewise be formed of an outer liner 14 and an inner liner 15 and which are secured around their periphery, by any manner, such as through the stitching as shown, and which liners might likewise contain the type of cushioning means as previously explained, so as to not only allow the pocket to be used for safekeeping of valuables, but likewise to augment the protection of the instep of the foot located directly there below.

The pocket includes a closure means, such as the zipper means 16 as shown, which encloses a slot formed, in this particular instance, through the outer liner 14, so as to facilitate access into the pocket, during the application or removal of items. And, once again, this closure means may be located anywhere along the location of the outer liner, and not particularly or specifically at that location as disclosed in this preferred embodiment. In addition, and as can also be seen, various apertures, as at 17, may be provided through one or both of the inner and outer liners, for ventilation purposes.

The means for fastening of the wraparound pocket 11 to this particular style of shoe may be made in the manner as previously described, as by stitching or through the use of other fasteners at the end location 13 of the shoe, while the opposite end may be held by means of any other form of releasable fastener, such as cooperating parts of Velcro 18 and 19, as disclosed.

Figure 21:
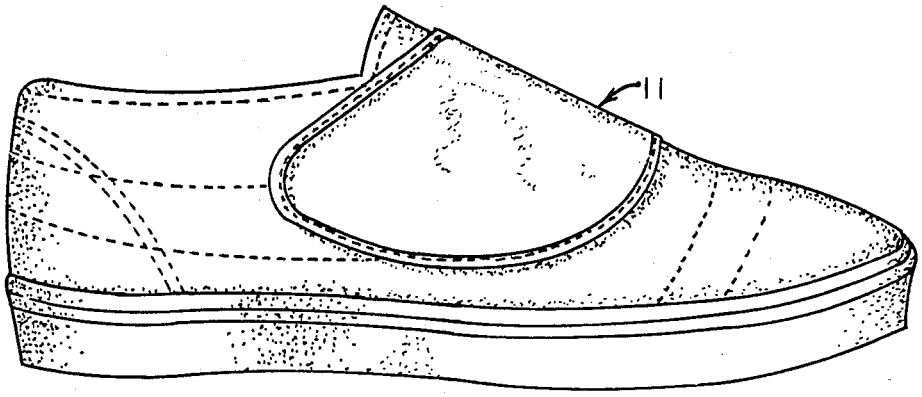
FIG. 21 provides a left side view of a wraparound pocket for footwear, in this instance comprising a casual shoe, with the pocket slot being arranged through the inner liner of the formed pocket.
Figure 22:
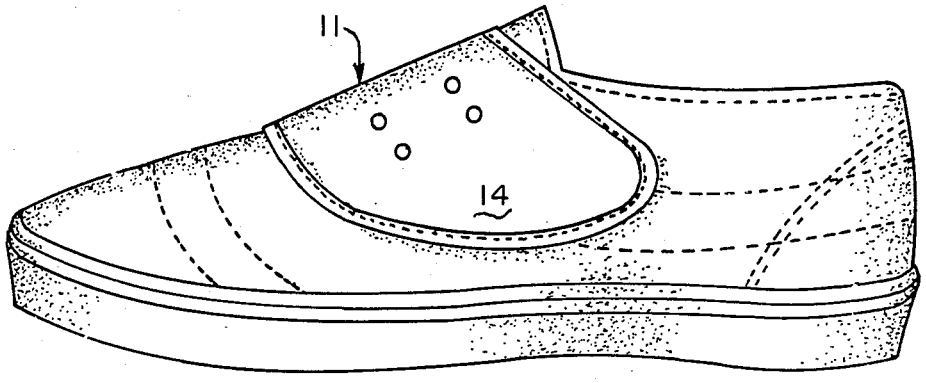
FIG. 22 provides a left side view thereof.
Figure 23:
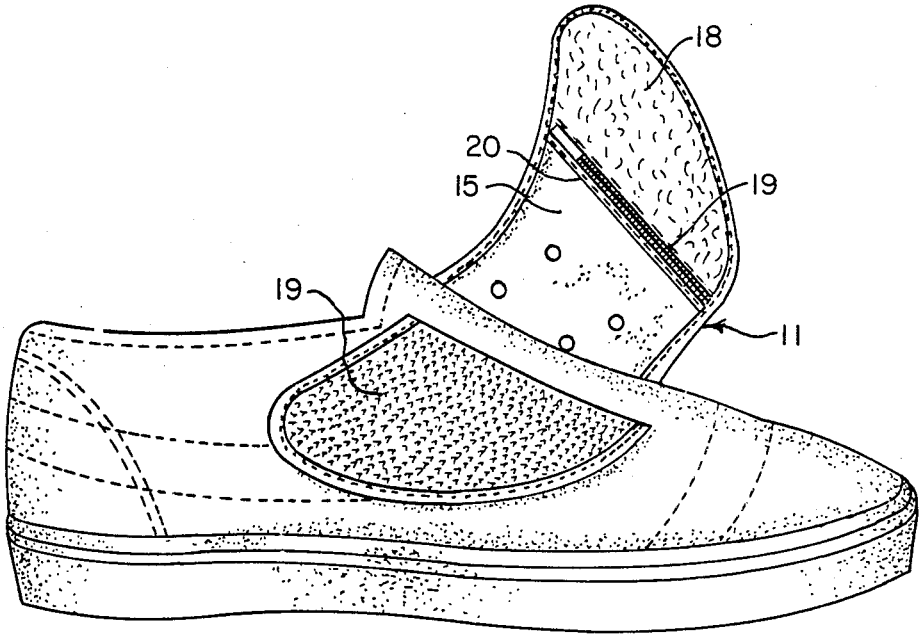
FIG. 23, provides a right side view thereof, with the pocket partially unwrapped.

A further embodiment of the particular style of shoe as previously explained is also shown in FIGS. 21 through 23, and this particular shoe is constructed similarly to that as explained with respect to the footwear shown in FIGS. 14 through 20, but, in this particular embodiment, the pocket 11 is formed of the various liners and is constructed for adhering, at least at one end, to the shown shoe, while the other end may be once again fastened by means of any type of securing means, such as the Velcro 18 and 19, as disclosed. But, in this particular instance, some means for concealment of the formed pocket is provided, in so far as the closure means, such as the zipper means 19, is disclosed as arranged upon the pocket slot 20 formed through the inner liner 15 of the structured wraparound pocket. Thus, when personal items are secured within the formed pocket, and it is folded into overlying relationship upon the accompanying shoe, in the manner as shown in FIGS. 21 and 22, one is not given the impression that the member 11 is actually a formed pocket, nor that any valuables or other items may be stored therein. And, once again, the closure means 19 may be arranged at any other convenient position through the inner liner 15, and not necessarily in the vertically disposed position as shown. And, furthermore, various types of cushioning means, such as that as previously explained at 10 with respect to the shoe shown in FIG. 8, may be arranged in conjunction with the inner liner 15, and perhaps in the outer liner 14, for adding to the convenience and comfort of the shoe during its usage.

Variations or modifications to the structured footwear, of the various designs described herein, may occur to those skilled in the art upon reviewing the subject matter of this disclosure. Such variations and modifications, if within the spirit and scope of the invention depicted herein, are intended to be encompassed within and protected by any claims to patent protection issuing upon this invention. The description of the preferred embodiment set forth herein is done so merely for illustrative purposes only.

Having thus described the invention what is claimed and desired to be secured by Letters Patent is:

1. In a pocket for footwear and designed to wrap around the upper fastening area of the footwear to partially conceal the same and to add support for the footwear when applied upon the foot of the wearer at such underlying location, said footwear being of the type having a vamp, a pair of quarter and heel portions all securing together and being integrally connected with the shoe sole, said pocket secured at said upper fastening area intermediate the quarter portions for aiding in the retention of the footwear upon the foot, the improvement which comprises, a wraparound pocket means secured at one side edge with the approximate upper edge of one quarter portion for the footwear, and being disposed for wrapping around the upper fastening means for the footwear, said pocket means approximately at its other side edge normally fastening with the approximate upper edge of the other quarter portion for the footwear, at least the fastening of said other side edge with the said proximate upper edge of the other quarter portion of the said footwear being releasable, said pocket means including a pair of liners, one of said liners being an outer liner, the other said liner being an inner liner, and said liners being substantially secured together at their edges to form an enclosed pocket, an access slot provided to furnish access into the formed pocket, and a closure means provided for closing of the said pocket access slot.

2. The invention of claim 1 and wherein said closure means comprises a zipper means.

3. The invention of claim 1 and wherein the means for releasably fastening said pocket means with the other quarter portion comprising hook and pile fastening means.

4. The invention of claim 1 and wherein said access slot being provided through the outer liner.

5. The invention of claim 4 and wherein said pocket means having an upper portion, and said access slot being arranged horizontally through the upper portion of the outer liner.

6. The invention of claim 1 and wherein said access slot being provided through the inner liner, and being substantially concealed when the wraparound pocket means is applied during usage.

7. The invention of claim 1 and wherein said access slot being arranged along the margin between the inner and outer liners.

8. The invention of claim 1 and wherein said footwear comprises in athletic shoe.

9. The invention of claim 8 and wherein said athletic shoe comprises a basketball shoe.

10. The invention of claim 1 and wherein said footwear comprises a casual shoe.

11. The invention of claim 1 and wherein at least one of said inner and outer liners includes cushioning means.

12. In a pocket for footwear and design to wrap around the tongue portion of the footwear and partially concealing the same, and to add support for the footwear upon the foot of the wearer at such underlying location said footwear being of the type having a vamp, a pair of quarter and heel portions all securing together and being integrally connected with the shoe sole, said pocket provided intermediate the quarter portions for aiding in the retention of the footwear upon the foot, the improvement which comprises, a wraparound pocket means secured at one side edge with one quarter portion for the footwear, and disposed for wrapping around the tongue portion of the footwear, said pocket means approximately at its other side edge normally fastening with the proximate other quarter portion for the footwear, at least the fastening of the said other side edge of the pocket means with the other quarter portion of the said footwear being releasable, said pocket means including a pair of liners, one of said liners being an outer liner, the other said liner being an inner liner, and said liners being substantially secured together at their edges to form an enclosed pocket, an access slot provided through one of said liners to furnish access into the formed pocket, and a closure means provided for closing of the said pocket access slot.

* * * * *

UNITED STATES PATENT AND TRADEMARK OFFICE

CERTIFICATE OF CORRECTION

PATENT NO. : 4,547,982

DATED : October 22, 1985

INVENTOR(S) : Robert J. Gamm

It is certified that error appears in the above—identified patent and that said Letters Patent is hereby corrected as shown below:

Please delete from the "Related U.S. Application Data" the statement: ---"Continuation-in-part of Serial No. 436,342, October 25, 1982, abandoned,"---.

Signed and Sealed this

*Seventh* Day of *January 1986*

[SEAL]

*Attest:*

DONALD J. QUIGG

*Attesting Officer*

*Commissioner of Patents and Trademarks*